US005597183A

United States Patent [19]

Johnson

[11] Patent Number: 5,597,183

[45] Date of Patent: Jan. 28, 1997

[54] INTERACTIVE BOOK HAVING ELECTROLUMINESCENT DISPLAY PAGES AND ANIMATION EFFECTS

[75] Inventor: William R. Johnson, Alberta, Canada

[73] Assignee: Junkyard Dogs, Ltd., San Jose, Calif.

[21] Appl. No.: 349,888

[22] Filed: Dec. 6, 1994

[51] Int. Cl.[6] ..... B42D 15/00

[52] U.S. Cl. ..... 283/83; 281/38

[58] Field of Search ..... 281/51, 15.1, 28, 281/38; 283/83

[56] References Cited

U.S. PATENT DOCUMENTS

| | | | |
|---|---|---|---|
| 4,532,395 | 7/1985 | Zukowski | 200/314 |
| 4,683,360 | 7/1987 | Maser | 200/314 |
| 5,118,138 | 6/1992 | Brotz | 281/51 |
| 5,122,890 | 6/1992 | Makow | 359/63 |
| 5,301,982 | 4/1994 | Brotz | 283/83 |

*Primary Examiner*—Willmon Fridie, Jr.
*Attorney, Agent, or Firm*—Thomas Schneck

[57] ABSTRACT

An interactive book having display pages which are illuminated via electroluminescent (EL) lamps is disclosed. A typical display page includes characters which may be individually illuminated by an underlying pattern of EL lamps, and membrane switches for the user to activate the EL lamps as desired. The sheets of the book are assembled with back-to-back display pages, i.e. with inner layers of EL lamps and outer layers of characters. The EL lamps may luminesce simply, such as with a single membrane switch for a single EL lamp, or a series of EL lamps may be connected to a sequencing circuit wherein activation of a single membrane switch causes a specific timing and order for luminescence of the EL lamp series. The sequence of the EL lamp series may be set to provide motion effects, such as animation, for the overlying characters.

19 Claims, 5 Drawing Sheets

INTERACTIVE BOOK HAVING ELECTROLUMINESCENT DISPLAY PAGES AND ANIMATION EFFECTS

TECHNICAL FIELD

The invention relates to devices having electroluminescent lamps and flexible membrane switches.

BACKGROUND ART

An electroluminescent (EL) lamp generally comprises a layer of phosphor disposed between two electrodes at least one of which is light-transmissive. A dielectric is also disposed between the electrodes, so the EL lamp functions essentially as a capacitor. When a voltage of alternating current is applied across the electrodes, the phosphor material is activated and emits light.

EL lamps may be manufactured as discrete cells or as large panels or rolls and either on rigid or flexible substrates. In addition, each component of the lamp may be formed as a separate layer, such as a foil sheet serving as an electrode and a planar dielectric sheet, with the layers later laminated together as by heat and pressure. Alternatively, the layers may be combined into overlapping coatings printed on a substrate, as is the case for a layer of light-transmissive conductive ink serving as a top electrode followed by a layer of phosphor ink in a dielectric matrix and then another conductive ink coating serving as a back electrode. EL lamps have found widespread uses, e.g. in signs, watch faces, and as backlighting for keyboards.

Membrane switches are also well-known. A membrane switch is generally constructed of two spaced-apart electrically conductive surfaces on separate substrates. At least one substrate is flexible. For example, each conductive surface may be a pattern of electrically conductive ink. A spacer layer with an aperture is positioned between the two facing conductive surfaces. When a user depresses the flexible substrate containing one of the conductive surfaces, the two conductive surfaces come into contact thereby causing activation of the switch and closing a circuit. Membrane switches have also been used in a variety of devices, such as on keyboards and control panels for appliances. See, e.g., U.S. Pat. No. 4,683,360 to Maser for a membrane switch combined with an EL lamp panel.

An object of the present invention is to provide a device utilizing EL lamps and membrane switches for imparting educational and entertainment information in an interactive manner.

DISCLOSURE OF THE INVENTION

The above object has been achieved with an interactive book comprised of a series of individual display pages. Each page includes a character-bearing, printable layer overlying a spatially-arranged display pattern of electroluminescent (EL) lamps with at least one EL lamp positioned directly underneath each character that has been selected for illumination. Each page also includes a membrane switch having an imprinted activation region which, when depressed by the user, closes the circuit for at least one EL lamp on the page and thereby causes activation of the lamp and illumination of the overlying character. By printing with various inks and on various surfaces, the EL lamps can be used to make characters appear and disappear, as well as change color.

In addition, the present invention includes a sequencing circuit operably connected to the electrical circuitry of at least some of the EL lamps on a page, that portion defining a sequenced series of lamps. The sequencing circuit is triggered by the touch of a membrane switch, as with the circuitry for the simple illumination of lamps. The sequencer is set for a specific pulse rate and order, causing timed and ordered activation of the EL lamp series. Precise timing and ordering of the sequenced series in combination with careful placement of printed characters on the display page provides motion effects, such as animation, of the characters.

The EL lamps are individually activatable, and the display pages are interactive in the sense that depression of a membrane switch by the user results in luminescence of a portion of the EL lamp pattern of the display page.

A typical page layout for a character-bearing layer will have graphics, membrane switches, and text. Some of the graphics are activated by membrane switches that cause simple illumination. Other portions of the graphics appear animated upon activation by a membrane switch because of the sequencing circuit interposed in the circuitry of the EL lamps underlying those graphics. Still other portions of the graphics may remain unactivated and simply function as completions of the partially-activatable scene on a display page. The text may indicate when the user is to depress a membrane switch so as to cause activation of some portion of the graphics.

Two display pages may be positioned with their EL lamp patterns facing inwardly and their character-bearing layers facing outwardly, to form a double-sided display sheet. Several of these display sheets may be bound in a book format. Power for the EL lamps may be supplied by a series of batteries and an inverter housed, e.g., in the spine of the book. Preferably, each page of the book is individually activatable by its own membrane switches and EL lamp patterns, but with a single sequencing circuit with preset timing and ordering connecting all pages having sequenced lamp series to exhibit motion effects. Alternatively, multiple sequencing circuits or patterns may be used so that different timing and illumination sequences may be set for the graphics portions of the various pages.

The present invention provides an application of EL lamp technology that will find utility in the educational and entertainment fields.

BEST MODE OF CARRYING OUT THE INVENTION

Figure 1:
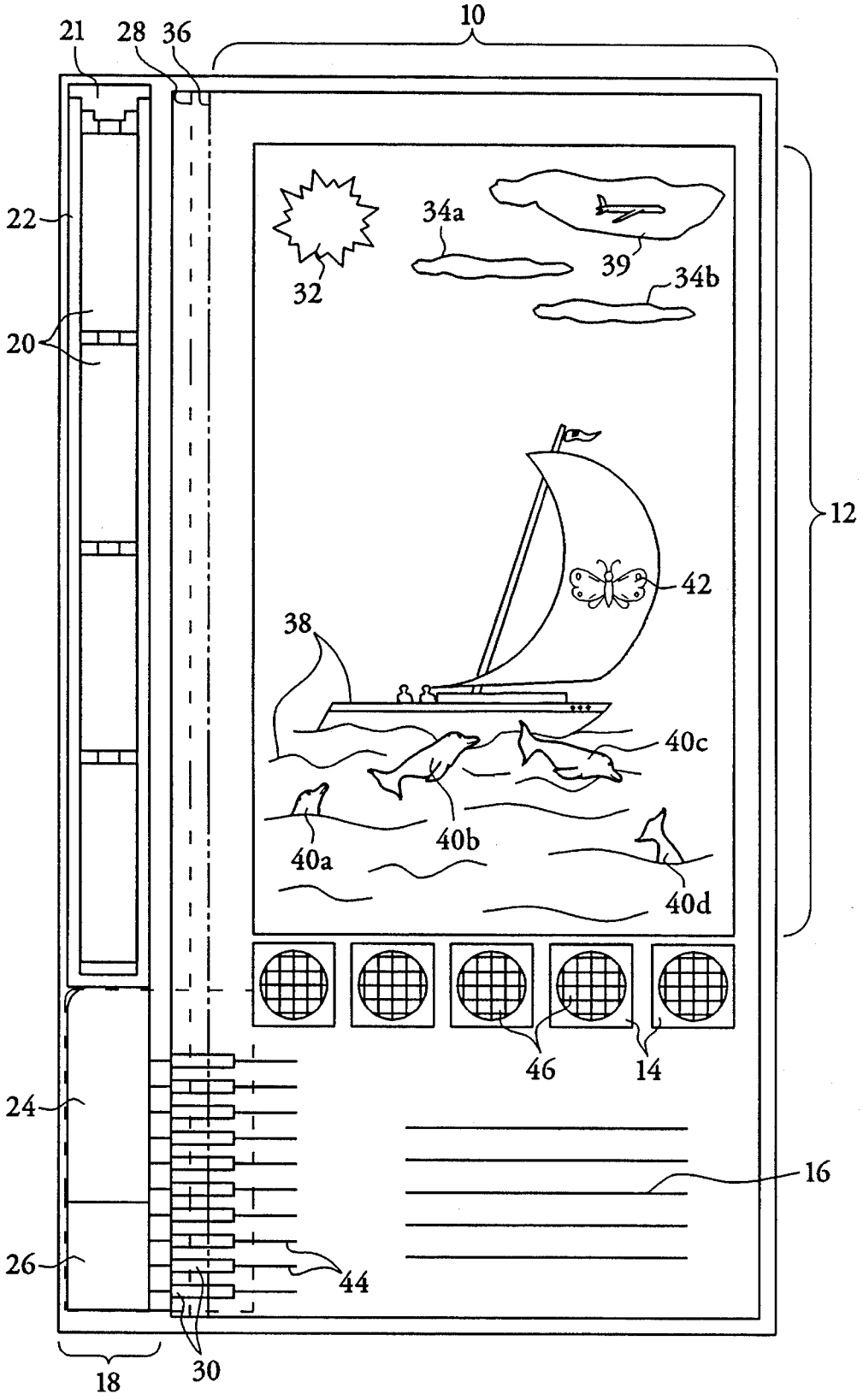
FIG. 1 shows a typical page layout for a character-bearing printable layer, according to the present invention, and also shows an example of the spine of a book having the display pages of the present invention.

With reference to FIG. 1, a typical page layout for the character-bearing, printable layer 10 of a display page contains a graphics portion 12, a series of membrane switches 14, and text 16. Although the graphics, membrane switch, and text portions of the page are shown in separate regions for ease of illustration, they may be interspersed, e.g. with the text containing instructions to depress the membrane switch at the end of the line of text, or a membrane switch incorporated into the illustrated scene. Additionally, text may be illuminated according to the present invention.

Printable layer 10 contains some translucent regions and a layer of EL lamps underlies printable layer 10 with the individual lamps positioned in a pattern corresponding to those portions of the graphics which are to be illuminated. For example, one EL lamp may be positioned under sun 32. Another lamp may be positioned to illuminate two closely-spaced parts of the illustration, such as clouds 34*a–b*. The characters may be the result of printing a positive silhouette, such as sun 32, on the outer face of printable layer 10 and a negative silhouette with dark ink directly underneath the positive silhouette. This refinement confines the illumination of the EL lamp below a character to that selected character. The EL lamps and printing can be combined to achieve a variety of effects. For example, a character may be printed on a translucent portion of a material of a single color and then change color when illuminated by an EL lamp of a different color. The characters themselves may be illuminated, such as sun 32, or may be printed in dark ink and be backlighted when an EL lamp illuminates the background as is the case for the dark airplane in front of cloud 39. Characters may also be printed on the inner face only of printable layer 10, such as butterfly 42, so that illumination via EL lamp makes the character "appear" on the outer surface of printable layer 10. The graphics portion 12 may also contain non-activatable portions, such as at 38, which simply complete the illustrated scene.

A unique feature of the present invention is the sequencing of EL lamps to cause motion effects, such as animation. Individual EL lamps may be positioned beneath individual characters, e.g. the dolphin at each of positions 40*a–d*. When the appropriate switch is activated, the EL lamps luminesce in a specified order, e.g. first the lamp at position 40*a*, then 40*b*, 40*c*, and finally 40*d*, giving the appearance of a jumping dolphin. When the sequencing circuitry is properly timed and ordered with the coordinating characters, animation effects may be achieved. In another instance, the characters may be printed on the inner surface of printable layer 10 in overlapping form and the EL lamps may be set at a rate designed to provide a smoother appearance of motion.

Activation of the EL lamps is caused by the membrane switches 14. A membrane switch may cause activation of one EL lamp and illumination of one character, as in sun 32 or butterfly 42, or activation of a series of EL lamps and a motion sequence within the graphics, as in the jumping dolphins at 40*a–d*.

The above-described printable layer 10 is presented as a single example of the top layer of a display page according to the present invention. Another display page having unique graphics, text, and EL lamp patterns may be affixed to the back of the first display page with the EL lamps facing inwardly and the character-bearing layers facing outwardly. The two together form a two-sided interactive EL display panel that serves as a sheet of a book. A plurality of display pages may be bound together in a book format, as with stitching at 28 and a fold line at 36 of FIG. 1.

The EL lamps of the assembled book preferably receive energy for luminescence from an internally housed source. Therefore, the assembled book preferably houses a power supply and circuitry common to the EL lamp patterns of each display page in a central area such as the spine 18 of the book, as illustrated in FIG. 1. The power to run the EL lamps may be supplied, e.g., by batteries 20 housed in a hollow tube 22 of spine 18 in conjunction with an inverter 26, also located within spine 18. Inverter 26 converts the DC voltage of the batteries into the AC voltage required to activate the EL lamps. Tube 22 is shown with a removable cap 21 at one end for replacement of the batteries 20. A battery input voltage in the range of 1½ V to 12 V may be used, with 6 V preferred. Typically, the inverter output is at a voltage in the range of 80 to 160 V and a frequency in the range of 400 to 2000 Hz, with 100 V and 1200 Hz preferred. Sequencing circuit 24 is also shown located in spine 18 of FIG. 1 because in the illustrated example, a single sequencing circuit having a set pattern is used for the motion-sequenced graphics of each display page. Alternatively, different timing and ordering patterns may be used for each display page.

FIG. 1 also shows electrical leads 30 and wiring 44 connecting to the circuitry for the EL lamp patterns of each display page. The sheets of the book are aligned and preferably conductive epoxy, not shown, is then used to interconnect the circuitry of the display pages, the power supply, and the sequencing circuit. Alternatively, metal eyelet-type rivets may be used to interconnect the circuitry.

Figure 2:
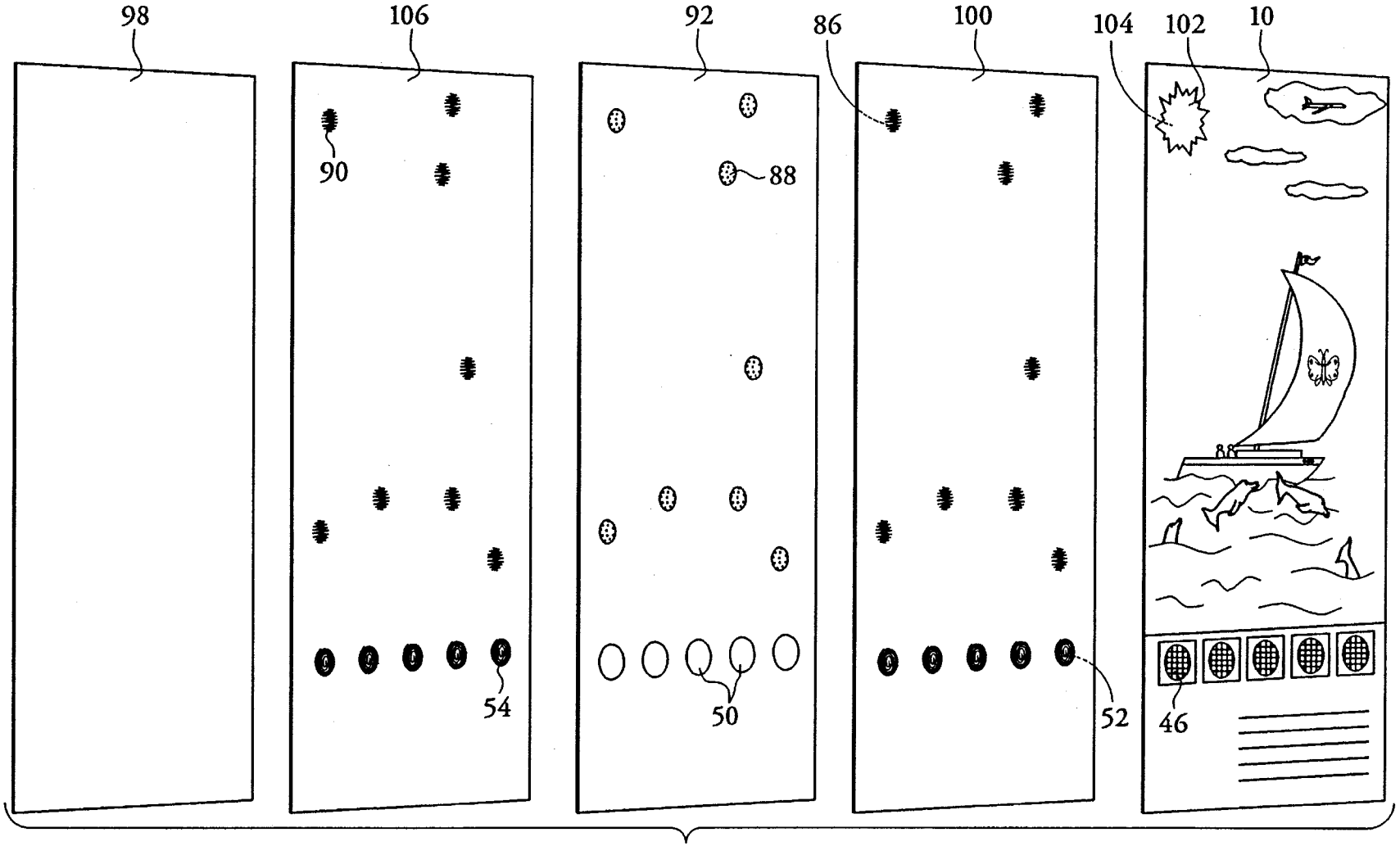
FIG. 2 is an exploded view of some of the layers of a typical display page of the present invention, with most of the electrical circuitry removed.

Referring to FIG. 2, character-bearing, printable layer 10 is shown with a printed positive silhouette 102 on its outer surface. A negative silhouette of the same character is printed on the backside, or inner surface, of printable layer 10, as indicated by 104. The characters may be printed with ink on the outer surface, inner surface, or both depending on the desired effect, as discussed above.

Below the printable layer 10 lies the EL lamp layer. The EL lamps of the present invention are preferably discrete cells which are situated close to printable layer 10 for maximum brightness of the overlying characters. For ease of illustration, the EL lamp layer has been separated into its components, but the connecting circuitry is not shown. The EL lamp layer shown is a typical EL polymer thick film with a top electrically conductive and light-transmissive ink pattern 86 serving as a top electrode and a bottom electrically conductive ink pattern 90 serving as a bottom electrode. Top electrode 86 is preferably disposed on the underside, or inner surface, of layer 100. Bottom electrode 90 is preferably disposed on the top, or outer surface, of layer 106. "Inner" and "outer" surfaces, as used here, refer to positions relative to a core or base, such as base substrate 98, of a typical display page or display sheet. Between the two electrodes lies the EL phosphor 88, which may also be in the form of an ink, and a dielectric 92. The electrodes 86 and 90 are aligned with the EL phosphor 88 and dielectric material 92 to form the EL lamp. Top electrode 86 is made light-transmissive to emit the luminescence of EL phosphor 88. A pattern of EL lamps is shown in FIG. 2 corresponding to selected characters of printable layer 10.

Although the various components of the EL lamps are shown as being incorporated in different segments of film, such as 100, 92 and 106, the present invention may be manufactured with the EL lamps being "printed" directly on the inner surface of printable layer 10. The components are thus laid down as successive coatings of first conductive ink, phosphor, dielectric matrix material, and second conductive ink. A combination of the coating and separate layer methods may be used to effectively combine layers 10 and 100 or 106 and 98, so that the conductive ink patterns are printed directly on layers 10 or 98 and only a separate dielectric and phosphor layer is between them. See FIG. 5. This combination of layers is also applicable to the conductive ink traces for the membrane switches, described below. Other types of EL lamps, such as those utilizing foil electrodes or phosphor-impregnated resins may also be used.

Figure 3:
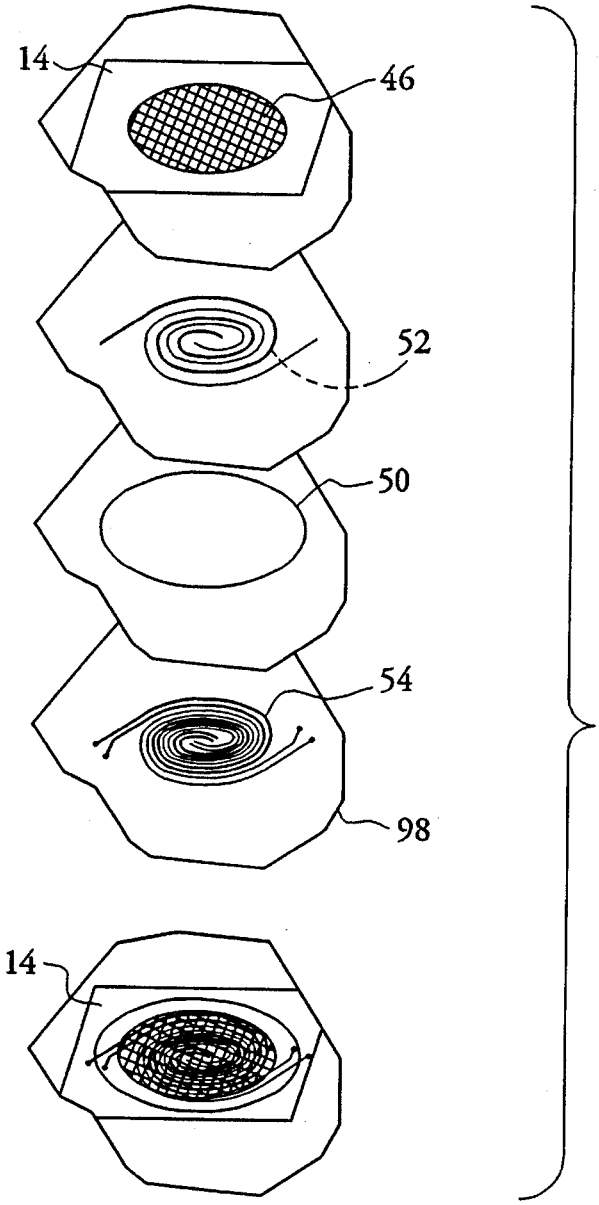
FIG. 3 provides an exploded view of a membrane switch according to the present invention.

Also below printable layer 10 are the inner components of membrane switches 14. FIGS. 2 and 3 illustrate the design of membrane switch 14, without connecting circuitry. The membrane switch includes a top pair of parallel spiral conductive ink traces 52 on a first surface, such as the underside of layer 100 or the inner surface of printable layer 10, and a bottom pair of parallel spiral conductive ink traces 54 on a second surface, such as the top surface of layer 106, as in FIG. 2, or base substrate 98, as in FIG. 3. The two sets of spirals are positioned to face each other, but are spaced apart with a spacer layer of predetermined thickness. The spacer layer contains apertures 50 which are aligned with the top and bottom sets of spirals 52 and 54, respectively. Printable layer 10 is printed with activation regions 46 of the membrane switches 14 indicating where the user should depress the switch. When the activation region 46 of a switch is depressed, top spiral set 52 comes into contact with bottom spiral set 54 through aperture 50, thus activating the switch and closing a circuit.

Although the spacer layer containing apertures 50 is shown in FIG. 2 as layer 92, i.e. the dielectric layer of the EL lamps, this is not a requirement. The spacer layer for membrane switches 14 may be completely separate from the EL lamp components and this is especially true if the EL lamps are formed as ink and resin coatings on the inner surface of printable layer 10. The layers of membrane switches 14 which contain the top set of spirals 52 and the activation regions 46 are preferably made of flexible material such that depression of activation region 46 causes sufficient deflection of those layers to allow contact of the top and bottom sets of spirals 52 and 54. A material such as Mylar offering flexibility for light-pressure touch activation and durability for use in children's books is preferred.

The display pages of the present invention are preferably constructed using nonporous, flexible polymer substrate materials such as Mylar. Paper or fabric may also be used. It may be desirable to use core substrates and spacer layers that are semi-rigid, however, for durability. The printable layers are preferably 0.003 to 0.020" thick. The base substrate 98 of FIG. 2 is preferably 0.010 to 0.035" thick. Layers 100 and 106 of FIG. 2 are preferably 0.010 to 0.020" thick. The dielectric layer 92 varies depending on the voltage used, but a thickness of 0.010 to 0.030" is typical.

Figure 4:
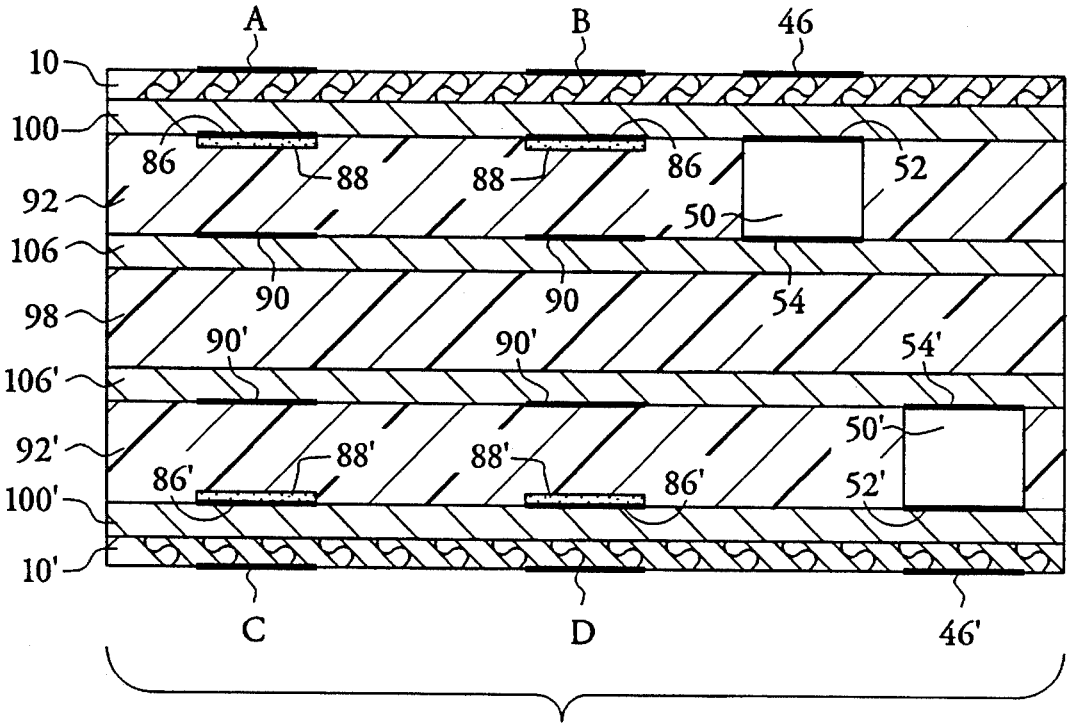
FIG. 4 is a cross-section of a typical double-sided display sheet of the present invention.

The printable layer 10 and underlying EL lamp and internal membrane switch layers 100, 92, and 106, are repeated in reverse form on the flip side of base or core substrate 98. Thus, FIG. 4 shows a cross-section of a complete double-sided, typical display sheet of the present invention. Layers 10, 100, 92, 106 and 98 are followed in order by a layer 106', similar to 106, a layer 92', similar to 92, a layer 100', similar to 100, and another character-bearing, printable layer 10', having a different scene in its graphics region and different text than printable layer 10. Preferably, the membrane switches on a first display page, or one side, shown e.g. as printable layer 10, of a double-sided display sheet, are not located directly opposite the membrane switches on the attached display page, or second side, shown e g as printable layer 10' of a double-sided display sheet. This placement avoids undesired activation which would waste battery power. Layers 92 and 92' are shown containing EL phosphors 88 and 88', respectively, and apertures 50 and 50', respectively. Conductive patterns and traces 86 and 52 are indicated on layer 100, as are 86' and 52' on 100'. Similarly, conductive patterns and traces 90 and 54 are indicated on layer 106, as are 90' and 54' on 106'. Membrane switch activation regions 46 and 46' are also shown on the printable layers. FIG. 4 shows positions A–D as possible locations for characters which are backlighted by the EL lamps. Additionally, the assembled double-sided display sheet may contain laminated coverings for durability.

Figure 5:
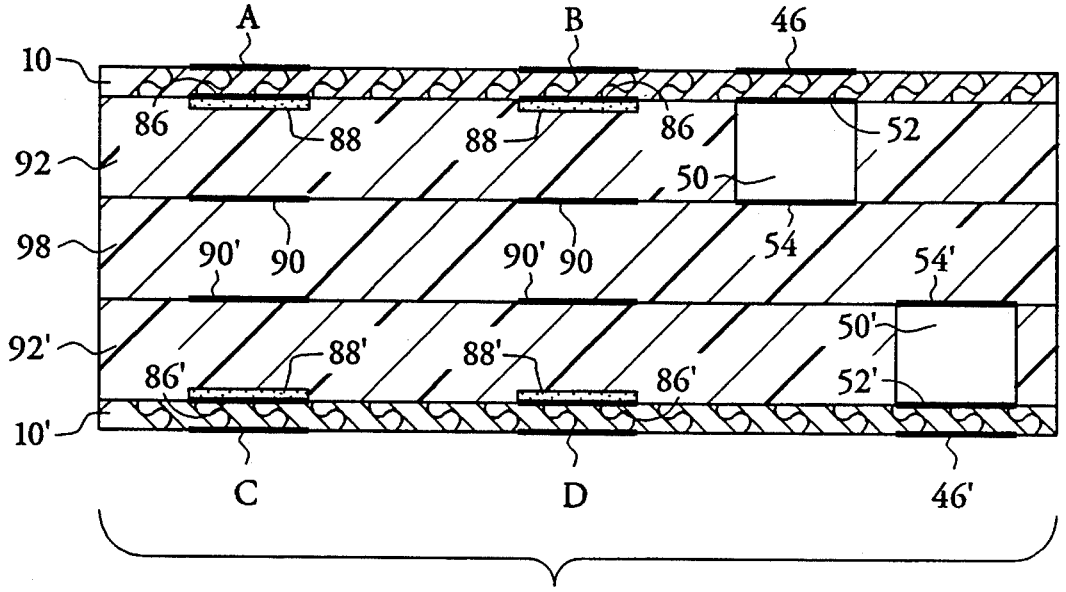
FIG. 5 is a cross-section of an alternate embodiment of a double-sided display sheet according to the present invention.

One alternative embodiment, described above and illustrated in FIG. 5, has a portion, i.e. the light-transmissive top electrodes 86 and 86', of each pattern of EL lamps printed on the back of the printable layer 10 or 10', eliminating layers 100 and 100'. The EL phosphor material 88 or 88' may also be included in the portion of EL lamp that is printed on the inner faces of printable layers 10 and 10'. FIG. 5 also shows layers 106 and 106' removed, as compared with FIG. 4. The bottom electrodes 90 and 90' are printed, then, on either the inner faces of dielectric layers 92 and 92' or on the surfaces of base substrate 98.

Figure 6:
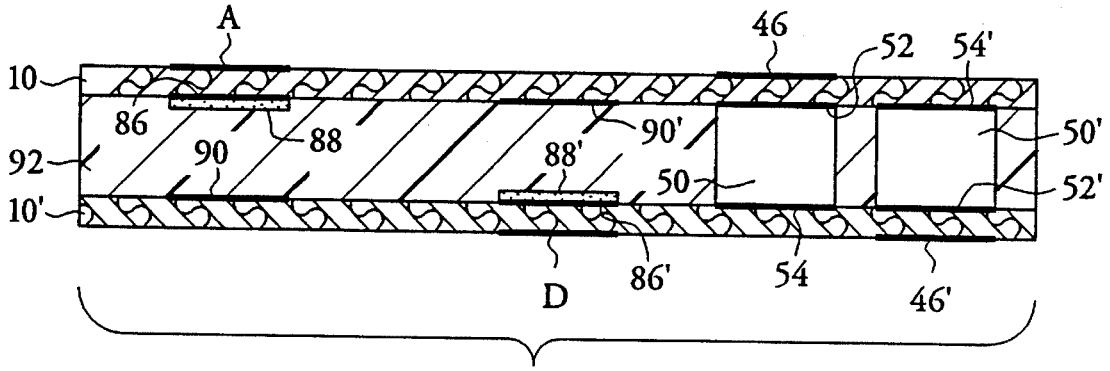
FIG. 6 is a cross-section of another alternate embodiment of a double-sided display sheet according to the present invention.

A further alternative structure for the display sheet of the present invention has a single EL film layer forming a core that may be used to illuminate both display pages of a double-sided display sheet, as illustrated in FIG. 6. This requires the EL film layer to be light-transmissive in directions towards both display pages, however. FIG. 6 shows a single EL film layer, i.e., the EL phosphor dielectric material, and top and bottom electrodes, serving to illuminate characters on both of the printable layers 10 and 10'. One EL lamp causes illumination at position A on layer 10 because its light-transmissive portion, 86 and 88, is directed toward layer 10. The other EL lamp has its light-transmissive portion, 86' and 88', directed toward layer 10' and thus causes illumination at position D. EL lamps that luminesce in both directions simultaneously may also be used. Note that in FIG. 6, the internal portions of the membrane switches are shown in adjacent positions of a single layer, but each has an activation region 46 or 46' in printable layer 10 or 10', as appropriate FIG. 7 contains an example of the electrical circuitry for a first page 60 and a succeeding page 62. Each page shown contains three simple EL lamps: 65, 67, and 69 on page 1 and 75, 77, and 79 on page n. The pages also each contain a sequenced series of EL lamps: 71*a–f* on page 1 and 81*a–f* on page n. All of the EL lamps are activatable by membrane switches whose activation regions are printed on the character-bearing printable layers overlying the lamps. For simplicity, the two pages contain identical EL lamp patterns. Different patterns may be used on the pages, however.

Figure 7:
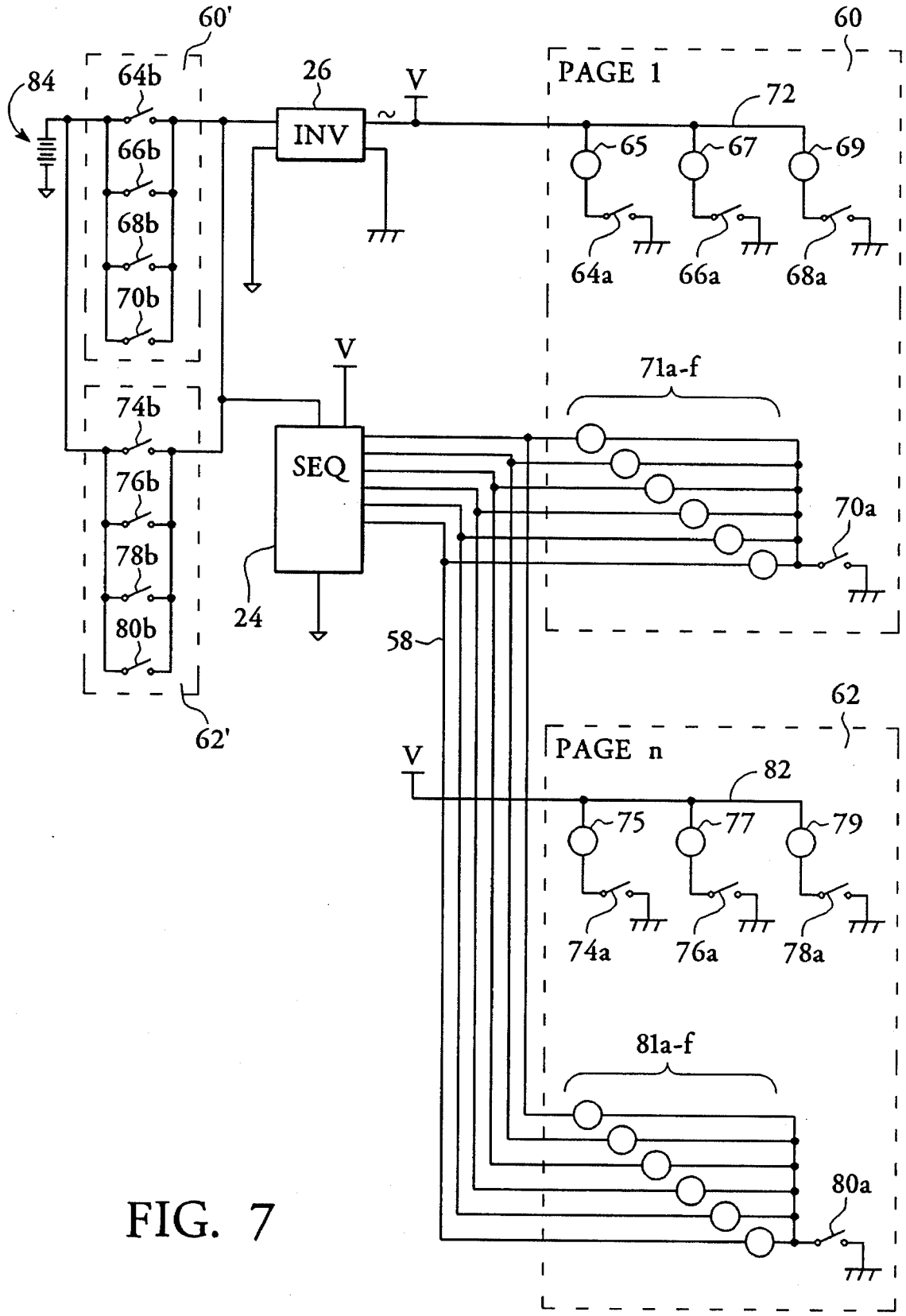
FIG. 7 is a block diagram of the typical electrical circuitry of the present invention.

The membrane switches 14 of the present invention are preferably of a double pole design, meaning that two poles of the switch are closed simultaneously. FIG. 7 shows the two poles of a single membrane switch as 64*a–b*. Activation of the membrane switch operably connected to EL lamp 65 closes the circuit at poles 64*a* at 60 and 64*b* at 60' and allows the AC voltage provided by DC voltage 84 and inverter 26 to cause luminescence of EL lamp 65. Simple EL lamp page circuitry 72 similarly allows luminescence of lamps 67 upon activation of switch 66*a–b* and lamp 69 upon activation of switch 68*a–b*. In the same manner, simple circuitry 82 for page n allows luminescence of lamps 75, 77,and 79 upon activation of switches 74*a–b*, 76*a–b*, and 78*a–b* respectively, with poles located at 62 and 62'.

Double-pole membrane switches are also utilized for activation of the sequenced series of EL lamps. Page 1 shows EL lamps series 71*a–f* activated by switch 70*a–b*. When the circuit is closed, sequencing circuit 24 through circuitry 58 causes luminescence of EL lamps 71*a–f* according to a set timing and ordering pattern. The sequencing circuit 24 is also operably connected to page n via sequencing circuitry 58. Thus, activation of switch 80*a–b* causes sequenced luminescence of EL lamp series 81*a–f*.

Each display page of the present invention is similarly connected to preferably both the sequencing circuitry 58 and the circuitry for simple luminescence, depending on the illumination requirements of the page. The placement and number of EL lamps for the EL lamp pattern of each page may vary. Additional electrical sequencing patterns may be set in the sequencing circuit, so that the timing and order of illumination on the various pages having sequenced lamp series need not be identical. Also, more than one sequenced lamp series may be present on a single page. The multiple sequenced lamp series on a page may contain different electrical sequencing patterns.

The double-pole membrane switch design allows the single electronic sequencing circuit 24 shown in FIG. 7 to control the sequenced series of EL lamps on all pages of the book individually. The first pole 70*a*, e.g., controls the sequencing circuit 24 and the second pole 70*b* connects the specific page, here 60', to the return side of the inverter 26.

The present invention provides a unique usage for EL lamps and membrane switches that will easily find application for educational and entertainment purposes.

I claim:

1. A display comprising, a layer bearing a first set of a plurality of icons, a tier of electroluminescent material disposed adjacent to said layer forming a pattern corresponding to said first set of icons, said pattern disposed to show a series of illuminated images corresponding to said plurality of icons of said first set, with said plurality of icons and said pattern arranged to provide an illusion of movement of said first set of icons upon said pattern being illuminated in accord with a predetermined sequence, and means, electronically coupled to said electroluminescent material, for activating said first pattern in accord with said predetermined sequence, with each of said plurality of icons of said first set adapted to be selectively viewable with an unaided eye upon said activating means illuminating said pattern.

2. The display page of claim 1 wherein said pattern includes a plurality of electroluminescent lamps, with the activating means having a plurality of membrane switches disposed in the tier, each switch providing contact of two conductive traces upon depression of an activation region, the contact causing switching of electric circuitry associated with at least one of the lamps, a power supply means for causing luminescence of each lamp operably connected to the contact within each switch.

3. The display page of claim 2 wherein the layer includes a second set of a plurality of icons, with said second set adapted to be viewable with said unaided eye on a continuous basis, whereby said first set is arranged to provide an illusion of movement of one of said second set of icons upon said pattern being illuminated in accord with said predetermined sequence.

4. The display page of claim 2 wherein at least a portion of the pattern of EL lamps is printed directly on a surface of the layer.

5. The display page of claim 1 wherein the character-bearing layer, lamps, and membrane switch are flexible.

6. An interactive book comprising, (A) a plurality of display sheets, each sheet comprising, (1) two printable layers, each layer having an inner face and an outer face, the layers printed with characters, (2) at least one film of electroluminescent lamps disposed between the two inner faces of the printable layers, each lamp positioned to underlie at least one of the characters and having associated electric circuitry, (3) a series of flexible membrane switches disposed in each sheet, each membrane switch connected to the electrical circuitry of at least one of the lamps and having a top activation region disposed in the outer face of one of the printable layers, two sets of conductive traces printed on two facing membrane layers below the activation region, and a spacer layer defining a hole, the spacer layer disposed between the two membrane layers with the hole positioned between the traces and below the activation region so that depression of the activation region allows contact of the traces through the hole of the spacer layer, the contact causing luminescence of at least one of the lamps, and in turn causing illumination of at least one of the characters, (B) a power supply associated with the film of lamps, and (C) means for connecting the display sheets into a book format.

7. The book of claim 6 further comprising a sequencing circuit associated with a series comprising at least two of the lamps causing variable timing and ordering of the luminescence of the series.

8. The book of claim 7 wherein the sequencing circuit causes timing and ordering of the series such that the characters overlying the series appear to be animated.

9. The book of claim 6 wherein the printable layers are made of a flexible material in the range of 0.003 to 0.020 inch in thickness.

10. The book of claim 6 further comprising lamination coverings for the printable layers.

11. A display sheet with motion effects comprising, a film of electroluminescent lamps, the lamps spatially arranged in a display pattern, a first printable layer having characters thereon disposed over some of the lamps, whereby the characters may be backlighted by the lamps, a second printable layer having characters thereon disposed over some of the lamps with the characters facing away from the film of lamps on a side distal to the first printable layer, an electrical sequencing circuit for applying energy to the lamps in a predetermined timed order, and a power supply connected to the sequencing circuit whereby motion effects may be produced by activating the lamps with the sequencing circuit.

12. The display sheet of claim 11 wherein the film of lamps and the printable layers are nonporous, flexible polymers.

13. The display sheet of claim 11 wherein the printable layers are paper.

14. The display sheet of claim 11 further comprising a contact switch formed by electrically conductive traces disposed below the first printable layer, the switch interposed between the sequencing circuit and the power supply.

15. The display sheet of claim 14 wherein the contact switch comprises a set of spiral traces on opposite sides of a spacer layer, with an aperture in the spacer layer allowing contact by opposed traces.

16. The display sheet of claim 15 wherein each set of spiral traces is further defined by a parallel pair of spiral traces and a first pole associated with the sequencing circuit and a second pole associated with the power supply.

17. The display sheet of claim 11 wherein the power supply comprises a cylindrical battery and an elongated inverter package housed in a hollow tubular spine, the display sheet having an edge joined to the spine.

18. The display sheet of claim 17 wherein the battery supplies voltage in the range of 1½ to 12 volts.

19. The display sheet of claim 17 wherein the inverter package has an output in the range of 80 to 160 volts and 400 to 2000 hertz.

* * * * *